US007972520B2

(12) United States Patent
Schmid

(10) Patent No.: US 7,972,520 B2
(45) Date of Patent: Jul. 5, 2011

(54) PROCESS FOR OPERATING A CENTRIFUGE

(75) Inventor: Joachim Schmid, Wallhausen (DE)

(73) Assignee: Fima Maschinenbau GmbH, Obersontheim (DE)

( * ) Notice: Subject to any disclaimer, the term of this patent is extended or adjusted under 35 U.S.C. 154(b) by 537 days.

(21) Appl. No.: 12/223,540

(22) PCT Filed: Jan. 30, 2007

(86) PCT No.: PCT/EP2007/000778

§ 371 (c)(1),
(2), (4) Date: Aug. 1, 2008

(87) PCT Pub. No.: WO2007/096044

PCT Pub. Date: Aug. 30, 2007

(65) Prior Publication Data

US 2009/0045147 A1 Feb. 19, 2009

(30) Foreign Application Priority Data

Feb. 22, 2006 (DE) ..... 10 2006 009 200

(51) Int. Cl.
*B04B 3/00* (2006.01)
*B04B 5/12* (2006.01)

(52) U.S. Cl. ..... 210/771; 210/772; 210/781; 210/784; 210/184; 210/360.1; 210/380.3; 494/13; 494/19; 494/29; 494/36; 494/37; 34/134; 34/315; 34/318

(58) Field of Classification Search ..... 210/771, 210/772, 781, 784, 184, 360.1, 380.3; 494/13, 494/19, 29, 36, 37; 34/134, 315, 318
See application file for complete search history.

(56) References Cited

U.S. PATENT DOCUMENTS

| | | | |
|---|---|---|---|
| 5,163,895 | A | 11/1992 | Titus |
| 5,300,233 | A | 4/1994 | Lee et al. |
| 5,891,347 | A | 4/1999 | Matsumoto |
| 6,159,360 | A | 12/2000 | Gerteis et al. |

FOREIGN PATENT DOCUMENTS

| | | |
|---|---|---|
| DE | 19648511 | 4/2002 |
| DE | 10311997 | 10/2004 |
| DE | 69711731 | 9/2005 |
| EP | 0454045 | 10/1991 |
| WO | WO 01/01055 | 1/2001 |
| WO | WO 02/078852 | 10/2002 |

OTHER PUBLICATIONS

Translation of teh Written Opinion of the International Searching Authority for PCT/EP2007/000778, undated.*

* cited by examiner

*Primary Examiner* — David A Reifsnyder
(74) *Attorney, Agent, or Firm* — Shlesinger, Arkwright & Garvey LLP

(57) ABSTRACT

The present invention relates to a process for operating a centrifuge which has a drive shaft used for loading, a drum which is connected to the drive shaft and has a drum casing and a drum base, a filter with a working region situated within the filter, an annular space formed between the filter and the drum casing, at least one drum base opening which is formed in the drum base and opens out into the annular space, and at least one swirl nozzle which is arranged in such a manner that it injects a fluid through the at least one drum base opening into the annular space. The process according to the invention includes the steps of loading a product suspension into the working region through the drive shaft, centrifuging the product suspension and drying the product suspension, wherein the drum rotates continuously during drying, and a fluid is injected into the drum through the annular space by means of the at least one swirl nozzle, and the rotational speed of the drum during drying is selected such that a product cake formed in the drum does not collapse.

30 Claims, 3 Drawing Sheets

PROCESS FOR OPERATING A CENTRIFUGE

RELATED APPLICATIONS

This is a national stage of International PCT Application No. PCT/EP2007/000778, filed Jan. 30, 2007, which claims the priority benefit of German Application No. 10 2006 009 200.7, filed on Feb. 22, 2006, both of which are hereby incorporated by reference.

FIELD OF THE INVENTION

The present invention relates to a process for operating a centrifuge.

BACKGROUND OF THE INVENTION

Centrifuges are generally known in the art. They are used, mainly in the chemical, the pharmaceutical and the food industry, for separating, in suspensions, i.e. substances having a liquid and a solid component, the solid phase from the liquid phase and for drying.

Generally, conventional centrifuges comprise a drum with a filter arranged in the drum. The filter can be configured as a rigid metal filter. The gap between the filter and drum wall is also referred to as the annular space. The region inside the filter is referred to as the working space.

In conventional centrifuges, the suspension is first loaded into the working space. This is conventionally done through the drive shaft which is hollow in its configuration, thus allowing it to be used as a loading shaft. The drive shaft is furthermore fixedly connected to the drum base and is used to drive the drum. Conventionally, the drive shaft is mounted horizontally.

The suspension is loaded into the working space as the drum rotates. As a result of the forces acting on the suspension in the radial direction, for example centripetal force, or the forces of inertia resulting therefrom, for example centrifugal force, the suspension is pressed outward against the filter. An appropriately high centrifugal force produces a stable liquid ring. This produces a suspension ring on the filter. The liquid phase then passes through the filter into the annular space and is discharged, whereas the solid phase remains in the working space.

In conventional centrifuges, the solid phase of the product clings tight to the filter after the liquid phase has escaped. The solid phase can in this case have a residual liquid content of up to 30%. The product which clings tight to the filter is in this state also referred to as a cake or ring cake, product cake or filter cake.

The centrifuged product having a high residual liquid content is, in the form present after centrifuging, generally not optimally suitable for onward conveyance for a further "drying" process step. It has been found to be particularly advantageous to dry the product directly in the working space. This eliminates the need to introduce product which is still moist and awkward to convey into a drying space via a transfer unit. In addition, in the case of toxic products, this reduces the risk for the personnel involved. Centrifuges in which a product is centrifuged and dried in the same working space are also referred to as centrifugal dryers.

In conventional centrifugal dryers, the cake must be blasted from the filter prior to drying. Provided for this purpose are swirl nozzles and drum base openings which open out into the annular space. The annular space itself is divided into a plurality of sections by webs, each section having a drum base opening. Furthermore, provision is conventionally made for the swirl nozzles to be able to be brought up to the drum base openings from the outside. A generally gaseous fluid is then injected at high pressure into the annular space through the swirl nozzles. The fluid then moves in the opposite direction through the filter and removes the solid phase of the product, which is pressed into the filter by the centrifugal forces, from the filter. This process is also referred to as blasting of the filter cake. Optionally, a plurality of swirl nozzles can be provided, so the swirl nozzles inject the fluid into the annular space simultaneously, or else there can be provided just one swirl nozzle which successively injects the fluid into the individual sections and thus blasts the filter cake piece by piece.

Blasting of the filter cake is followed by drying of the product. Drying is conventionally carried out by means of either fluidised bed drying or fixed bed drying.

During fluidised bed drying, typically either a stop-and-go process or a continuous process is applied. In the case of the stop-and-go process, a hot drying fluid is injected into the working space through the drum base openings by means of the swirl nozzles. The drum is then rotated further by a specific degree and a further shot of drying fluid is injected into the working space. Thus, the product is dried by the hot gas and mixed up by the successive rotation of the drum in such a manner that the product dries as uniformly as possible.

During continuous drying, the swirl nozzles are not brought quite up to the drum base; instead, a minimal gap is left between the nozzles and the drum base. The drum then rotates continuously at slow speed and an appropriate regulating system of the centrifugal dryer causes the swirl nozzles to inject the drying fluid whenever a drum base opening is situated before the swirl nozzle outlet. To simplify the regulating, the drum base openings are conventionally formed as slots. In this way, even during continuous drying, the product is dried by the drying fluid and repeatedly mixed up by the continuous rotation of the drum, so drying is carried out as uniformly as possible.

During fixed bed drying, the product cake is initially not blasted. Instead, a hot drying gas is introduced into the working space, which flows through the product cake from the inside outward, i.e. from the working space in the direction of the annular space and thus deprives the product cake of moisture. The product cake is thus dried in its ring form and only then is it detached from the filter. This can also be done, for example, by blasting or by inverting the filter in the case of an inverting filter centrifuge.

Following drying, the dried product, which generally assumes the form of a powder, can be removed from the working space and processed further.

However, in the above-described conventional processes, the processing of specific products is problematic. In particular in products having a broad grain size spectrum and a high fine grain content, centrifuging is seriously impeded.

Sedimentation of the relatively large product components takes place as early as during loading. Owing to their differing mass-to-surface area ratios, the relatively large product components move rapidly outward against the filter. However, the fine component initially floats in the liquid and is deposited outward against the filter more slowly. In this case, the fine product components clog the gaps between the relatively large product components, in many cases preventing the liquid phase from flowing away through the capillary between the relatively large product components. During centrifuging the liquid phase then flows only extremely slowly or even not at all. Increasing the rotational speed of the drum does not solve this problem either. The problematic products thus yield after centrifuging a residual liquid content of the product of up to 70%.

In addition, during drying by means of fluidised bed drying of the above-mentioned products having a broad grain spectrum and a high degree of moisture, the product soon forms lumps. During conventional fluidised bed drying, product components, which are moved upward as a result of the rotation of the drum, continually roll down onto the drum base along the remaining product components. The tendency of the product to form lumps is thus greatly promoted, as during the downward rolling relatively small product particles cling to relatively large product particles and increasingly large lumps are thus formed. However, the tendency of the product to form lumps during drying has significant drawbacks. Thus, firstly, the relatively large lumps cannot be dried satisfactorily, as they remain very moist on the inside; secondly, a product which has formed lumps has very poor suitability for further processing.

During conventional fluidised bed drying, what are known as drying cracks frequently form in the product cake during drying. Obviously, escaping of the drying gas through these cracks is promoted owing to the relatively low resistance, so the bulk of the drying gas escapes through the drying cracks without passing through the product per se and having a drying effect. On the one hand the drying gas is not efficiently used in this way, on the other hand the cake cannot be dried uniformly. In addition, high-heat regions, in which the product can become damaged or undesirable chemical reactions occur, are formed in the environment of the drying cracks.

This may create the need for additional and essentially superfluous finishing of the product in order to obtain product consistency which can be processed further.

Furthermore, the filters, in particular metal filters, cannot be produced with as small a mesh size as may be desired. The minimum mesh size is currently about 10 μm. In the case of products having a high fine content, i.e. approximately 20% of the product has a grain size of less than 10 μm, the bulk of the product is lost during the conventional drying process. Specifically during fluidised bed drying, the fine component is constantly atomised and escapes together with the drying gas into the annular space through the filter. Thus, in the case of the conventional processing methods, a significant proportion of the product is frequently lost.

Finally, in the case of specific products, strict conditions are placed on the type and manner of processing. Thus, for example, a maximum temperature of the drying gas may be defined, as a higher temperature would result in damage to the product or undesirable chemical reactions. Also, in many cases a very low maximum residual liquid content of approximately 1% is defined, it is almost impossible to adhere to the conditions using the conventional processes. This is particularly the case with products in the food sector and from the chemical and pharmaceutical sector.

A process for operating a centrifugal dryer according to the present invention is proposed to solve the foregoing problems.

SUMMARY OF THE INVENTION

In the process according to the invention, the rotational speed of the drum during drying is selected to be sufficiently high to prevent the product cake from collapsing. This means that although a drying fluid is injected into the working space through the filter in the opposite direction by means of at least one swirl nozzle and the product cake is thus repeatedly loosened up, swirled and dried, the radial forces acting on the product as a result of the rotation of the drum prevent the product cake from collapsing. The product cake is thus kept permanently stationary during drying.

This gives rise firstly to the advantage that the product cake itself acts as a filter during drying. This prevents the fine matter component from becoming lost during drying. This results in a significantly higher product yield and increased economy of the process.

During drying, the hot drying gas is injected into the working space by means of the swirl nozzles. As described hereinbefore, as a result of the forces in the radial direction which are caused by the rotation of the drum, the ring form of the product is permanently preserved even during drying. In addition, the injecting of the drying gas into the working space through the annular space, i.e. from the outside inward, provides a significant advantage over the prior art.

During conventional drying processes, the hot drying gas flows, in the case of fixed bed drying, through the product cake only once from the inside outward, i.e. from the working space in the direction of the annular space. During fluidised bed drying, the drying gas flows through the cake once from the outside inward in the lower region of the drum and escapes from the drum in an upper region without repassing through the product.

However, in the process according to the invention, the hot drying gas flows through the product cake initially from the outside inward. As the hot drying gas has to escape back out of the working space, it flows through the product cake again at a different point, from the inside outward, and escapes into the annular space. The drying gas therefore passes through the product cake twice, resulting in significantly more effective utilisation of the capacity of the drying gas to absorb moisture and in more rapid drying of the product cake. In addition, as a result of the permanent swirling of the product, the porosity of the product also increases, thus allowing the drying gas to infiltrate the product more easily and more uniformly. In order to assist the movement of the drying fluid from the inside outward, the pressure in the drum can be increased. This can be carried out by additional pumping-in of drying gas through the loading shaft.

In addition, the introduction of a drying gas into the working space through the loading shaft improves the drying of the product ring on both sides. The uniform drying of both sides allows more homogeneous drying of the product, avoiding undesirable local overheating.

In the process according to the invention, the permanent loosening-up of the product cake prevents the formation of drying cracks. On the one hand, the drying cracks are directly destroyed by the drying gas which is injected into the working space by means of the swirl nozzles, or else the drying cracks are immediately clogged up again by swirled relatively fine product components. Thus, even the drying gas led into the working space through the loading shaft is forced to pass through the entire product, from the inside outward, and thus dries the product more effectively.

Finally, the process according to the invention also prevents the product from forming lumps owing to agglomeration. Keeping the product cake stationary during drying prevents the above-described lump-forming mechanism, as the moist product components are no longer able to roll downward and stick. Accumulation of the product on the drum base, which occurs after blasting and in many cases marks the onset of clump forming, no longer occurs either.

In a further development of the process, a fluid can be injected into the drum through the annular space by means of the swirl nozzles as early as during centrifuging. As a result, the product is loosened up as early as during centrifuging and the product is prevented from clinging tight to the filter. This prevents not only clogging of a product having a broad grain size spectrum but also clinging of the product in the ring form to the filter. This significantly shortens the duration of centrifuging, as the liquid phase can flow away more rapidly owing to the more porous product.

The step according to the invention of centrifuging while constantly loosening up the product cake can, of course, also be applied separately in any desired process for operating a centrifuge. Thus, the centrifuging step can also be applied, in particular, before any conventional drying step such as, for example, conventional fixed bed drying or conventional fluidised bed drying on any desired type of centrifuge.

Of course, the internal pressure of the drum can also be increased as early as during centrifuging, by pumping a suitable gas through the loading shaft, to accelerate escaping of the liquid phase.

At least one swirl nozzle is provided for injecting the fluid into the annular space. In one embodiment, two swirl nozzles are used. The swirl nozzles are in this case, on the one hand, arranged in what is known as the 6 o'clock position, i.e. approximately at the low point of the drum, and in the 7 o'clock position, i.e. somewhat laterally offset from the low point. In one embodiment of the invention, the swirl nozzle in the 7 o'clock position is offset relative to the swirl nozzle in the 6 o'clock position by an angle of approximately 30°.

The 6 o'clock position is particularly advantageous because acceleration due to gravity is also added to the radially outward acceleration owing to the circular movement of the product. The outwardly acting forces are therefore greatest in the 6 o'clock position. The highest pressure when injecting the fluid to loosen up the cake can therefore be applied and the best increase in porosity achieved at this point.

In one embodiment of the invention, the annular space is divided into 12 sections, each having a drum base opening in the form of a slot or oblong hole. During a revolution of the drum, the two swirl nozzles can inject the fluid into the same drum base opening or else into various drum base openings. If the swirl nozzles inject the fluid into the same drum base opening, this means that during clockwise rotation of the drum first the swirl nozzle in the 6 o'clock position injects the fluid into the specific drum base opening and afterwards, once the drum has advanced and the specific drum base opening is situated before the swirl nozzle in the 7 o'clock position, the swirl nozzle in the 7 o'clock position injects the fluid into the specific drum base opening. In this way, it may be ensured that sufficient fluid is injected into the drum and an appropriate swirling effect occurs.

It should be noted at this point that the direction of rotation of the drum and the representation of the positions of the swirl nozzles based on clock times have been selected merely to facilitate description and should not be understood as entailing limitation. The direction of rotation of the drum and the precise position of the swirl nozzles can vary and, in addition, always depend on the direction of viewing.

In one embodiment of the process, provision may be made for the swirl nozzles each to inject, during each revolution of the drum, into offset drum base openings. Provision may be made for the fluid to be injected offset in each case by one drum base opening during each movement of the drum. This ensures that the product is swirled over the entire circumference of the drum.

In one configuration of the process, the drum rotates during loading of the product suspension into the drum. Fluid can then be injected by means of the swirl nozzles right from the outset of loading.

As will be described hereinafter in greater detail, according to the invention, the drum rotates during injecting of fluid at a lower rotational speed than is normally the case during conventional centrifuging in the corresponding process steps. At a drum diameter of 400 mm, the rotational speed during injecting is approximately 150 revolutions per minute. However, it is impossible for a stable liquid ring to build up at this rotational speed.

Owing to the relatively low viscosity of the liquid suspension component, it is difficult to transfer the shearing forces from the sludgy solid component, which builds up rapidly during loading to form a ring, to the liquid component. A kind of lake consisting of the loaded suspension is therefore formed within the solid ring which has already built up. In the process according to the invention, the loosened-up solid ring is capable of entraining a thick layer of the liquid component over a specific angular distance before the layer becomes redetached from the solid ring. However, an approximately 1 mm-thin suspension layer remains over the entire solid ring.

The swirling of the suspension lake, owing to the rotation of the drum, prevents sedimentation of the suspension and separation of the product components having relatively large grain sizes from the fine components. This layer formation of the various grain sizes takes place in the conventional process as early as during loading and continues during centrifuging. However, in the process according to the invention, this is prevented from the outset.

As a result of the permanent swirling of the solid ring by means of the injected fluid, the solid ring becomes substantially more permeable for the suspension ring lying thereabove. As the suspension ring lying thereabove is approximately just 1 mm thick and the solid ring is constantly swirled, the suspension ring filters out very rapidly. This prevents any sedimentation in the liquid ring.

Furthermore, provision may be made for the product to be loosened up throughout the process, i.e. the product is loosened up during loading, centrifuging and drying, by means of the fluid injected into the working space through the swirl nozzles. The loading step can then merge seamlessly with the centrifuging step, the centrifuging step can then merge seamlessly with the drying step.

In one embodiment of the process, the drying can also be followed by what is known as a homogenisation step. During the homogenisation step, the drum rotates likewise continuously but at such reduced speed that the product cake collapses. As stated hereinbefore, the permanent loosening-up of the product cake eliminates the need for blasting and, if the rotational speeds of the drum are reduced accordingly, the product cake automatically collapses and the product trickles to the drum base. The product then has the form of a dry fine powder which, together with the drum, repeatedly moves upward but falls back down to the drum base before reaching the summit. However, as the product has already been dried as desired, the product then no longer forms clumps. On the contrary, the product is blended uniformly, so the grain sizes of the product particles are distributed uniformly over the entire product and even the remaining moist components are distributed homogeneously over the product.

As stated hereinbefore, the rotational speed of the drum during loading, during centrifuging and during drying is selected such that the product cake is preserved and also does not collapse, despite the fluid injected by means of the swirl nozzles. Merely during homogenising is a lower rotational speed selected, so that the product falls down before reaching the summit of the drum.

Furthermore, the possible rotational speeds are upwardly capped as a result of the fact that, as the rotational speed rises, the dwell time of the drum base openings before the swirl nozzles at some point becomes too short to inject an amount of fluid required for loosening-up. There is then too little fluid to mix the product cake up in the desired manner.

A minimum rotational speed therefore results at all times from the point at which the ring form of the product cake is no longer preserved and the product cake collapses, and a maximum rotational speed results from the amount of fluid which the swirl nozzles can issue in a specific period of time, and also from the form of the drum base openings and the dwell time associated therewith of the drum base openings before the swirl nozzles.

For a drum having a diameter of 400 millimeters and a division of the annular space into twelve sections, each section having a drum base opening in the form of a slot, the following possible rotational speeds of the drum could be determined for the corresponding process steps.

It should however expressly been noted at this point that the calculated rotational speeds are also transferable by means of mechanical laws to any other drum sizes. In principle, the process according to the invention can be applied to centrifugal dryers of all sizes and with any desired division of the annular space.

For centripetal acceleration a during circular movement, the following applies:

$$a = \sqrt{\frac{v^2}{r}} \tag{1}$$

wherein v is circumferential velocity and r the radius of the circular movement. For v, the following also applies:

$$v=\omega*r. \tag{2}$$

The following is thus obtained for centripetal acceleration:

$$a=\omega^2*r. \tag{3}$$

At the rotational speeds specified in the present document and the drum radius of 200 millimeters, the acceleration acting on the product can thus be approximately determined and therefore at least approximately calculated back to the necessary rotational speeds at other drum radii. The necessary rotational speed $\omega_2$ at a drum radius of $r_2$ is obtained, using a drum radius of $r_1$ of equal to 200 mm and the rotational speeds $\omega_1$ specified hereinafter, as follows:

$$\omega_2 = \omega_1 * \sqrt{\frac{r_1}{r_2}} \tag{4}$$

The rotational speeds specified in this case for a drum diameter of 400 mm are thus transferable by means of Equation (4) at least approximately without difficulty to other drum sizes.

In addition, as an alternative, the accelerations acting on the product cake are specified in g.

For rotation of the drum while permanently loosening up the product cake by injecting a suitable fluid into the working space through the annular space by means of the swirl nozzles, a suitable rotational speed of between 120 to 150 revolutions per minute was calculated at a drum diameter of 400 mm. This corresponds to an acceleration acting on the product cake of 5 g.

The rotational speed of 150 revolutions per minute or the acceleration of 5 g can be applied during loading, during centrifuging and during drying. Especially during drying, a rotational speed of approximately 150 revolutions per minute leads to a product which is particularly suitable for further processing. The described drying step according to the invention leads to improved and more effective drying and a qualitatively improved end product not only in the described problematic products but rather generally in all types of products.

In the case of less problematic products which do not clog during centrifuging, a higher rotational speed of approximately 500 revolutions per minute at a drum diameter of approximately 400 mm can obviously also be applied during loading and centrifuging to accelerate centrifuging. The acceleration acting on the product cake can be up to 55 g during loading, up to 600 g during centrifuging. In the case of particularly coarse-grained products, acceleration of up to as much as 2,000 g is possible on suitable centrifuging. During drying, the rotational speed is then reduced again to approximately 150 revolutions per minute.

In the case of problematic products which clog rapidly and slow centrifuging down considerably, the process according to the invention could be used to double the outflow rate during centrifuging. This allows accelerated processing, which is therefore advantageous in terms of operational economy, of the product.

During homogenising, a suitable rotational speed is from approximately 50 to 80 revolutions per minute at a drum diameter of approximately 400 mm. Taking account of the accelerations acting on the product cake, the rotational speed should accordingly be selected such that the acceleration, which acts radially outward owing to the circular movement, is less than 1 g, so acceleration due to gravity causes the product to fall downward in the upper region of the drum.

Further advantages and configurations of the invention will emerge from the description and the accompanying drawings.

It will be understood that the above-mentioned features and those which will be described hereinafter can be used not only in the respectively specified combination but rather also in other combinations or in isolation without departing from the scope of the present invention.

BRIEF DESCRIPTION OF THE DRAWINGS

The invention is illustrated schematically with reference to an exemplary embodiment in the drawings and will be described in detail hereinafter with reference to the drawings.

DETAILED DESCRIPTION OF THE INVENTION

Figure 1:
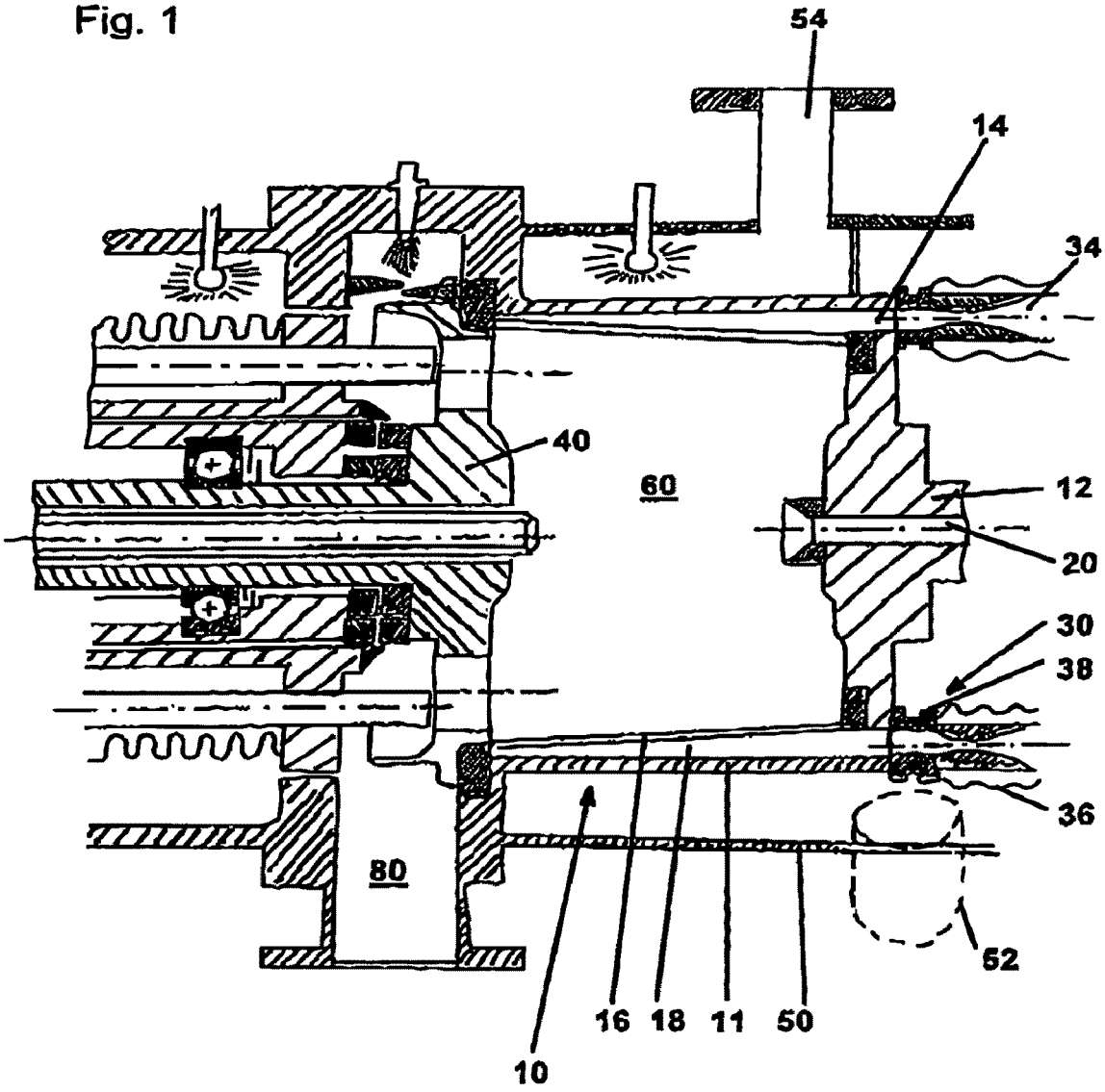
FIG. 1 shows a lateral cross section of a centrifugal dryer on which the process according to the invention can be carried out.

FIG. 1 shows a centrifugal dryer on which the process according to the invention can be carried out. The centrifugal dryer has a drum 10 comprising a drum casing 11 and a drum base 12 which is rigidly connected to a drive shaft 20 used for loading. The drum base 12 also has drum base openings 14. A metal filter 16 is arranged within the drum 10. An annular space 18, into which the drum base openings 14 open out, is situated between the metal filter 16 and the drum casing 11. In the illustrated embodiment, the annular space 18 is divided into twelve sections, each having a drum base opening 14 formed as an oblong hole.

The working region 60, in which the product is processed, i.e. centrifuged and dried, is situated within the filter 16. Opposite the drum base 12 the working region 60 is closed off by a baffle plate 40 which can be opened. When the battle plate 40 is opened, the product can be transferred to the region 80 from the working space 60 and removed.

Also provided are an outflow or drain 52, through which the liquid phase of the product can flow away, and an outlet 54 through which the gases introduced into the working region can escape.

Figure 2:
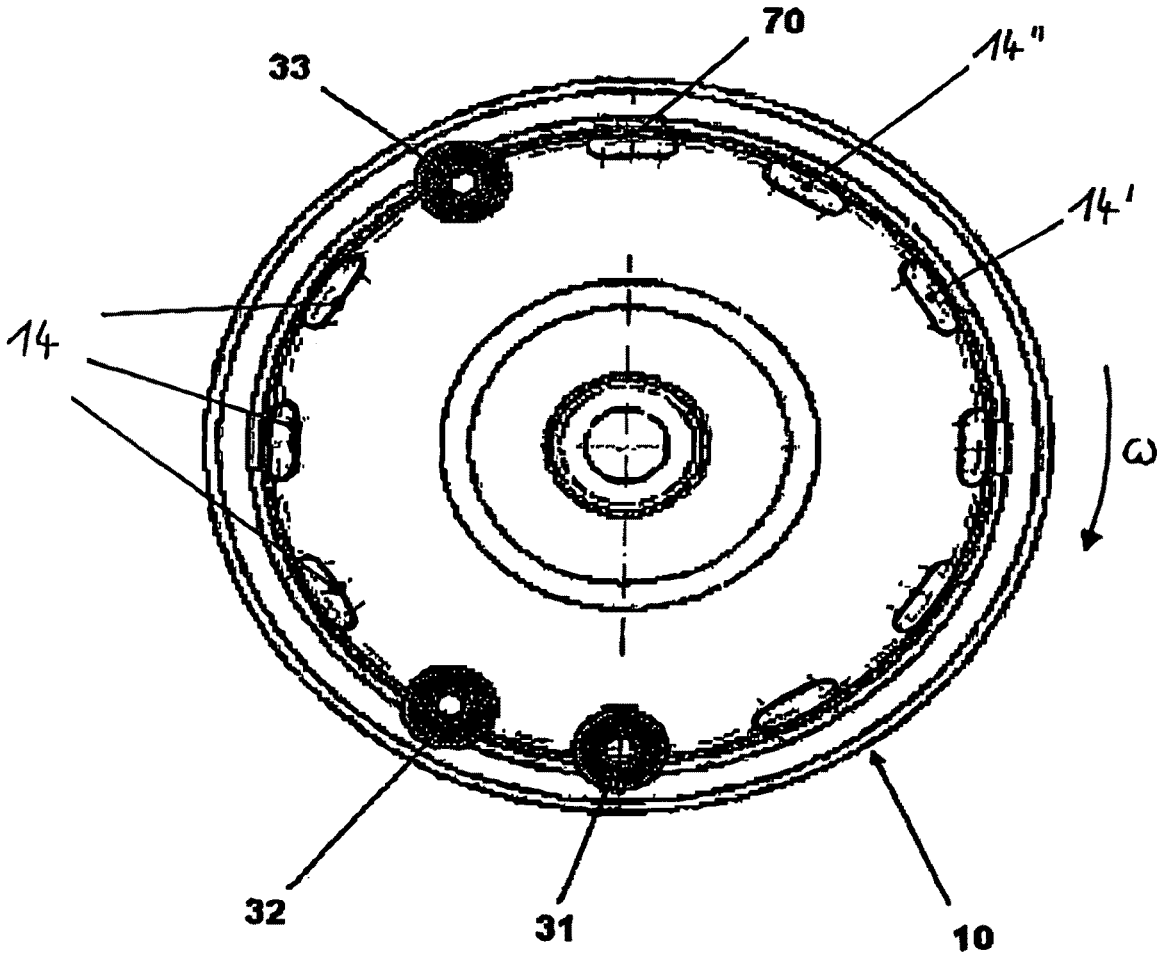
FIG. 2 shows a schematic front view of a drum with possible positions of the swirl nozzles and the drum base openings to carry out the process according to the invention.

FIG. 2 is a schematic front view of the drum 10. In the present example, the direction of rotation of the drum 10 is clockwise. Also shown are the vertex 70 of the drum 10 as well as a first swirl nozzle 31 and a second swirl nozzle 32. The first swirl nozzle 31 is situated in as the so-called 6 o'clock position and the second swirl nozzle 32 is situated in the so-called 7 o'clock position. The first swirl nozzle 31 is offset from the second swirl nozzle 32 by approximately 30°. Further swirl nozzles, such as for example the third swirl nozzle 33 which is arranged in the 11 o'clock position, can also be provided. The swirl nozzles inject a suitable fluid, which is preferably gaseous, into the working region 60 through the drum base openings, which are formed as slots 90, through the annular space 18 and the filter 16.

As further preconditions, the centrifugal dryer which is used should have as a drive a single-motor design. This allows all of the rotational speeds between a standstill and a maximum rotational speed of the drum to be operated continuously. This is important insofar as many conventional centrifugal dryers use a two-motor design which has a main motor and a geared motor. The motors are connected via a centrifugal clutch which, however, is fully opened only at a rotational speed of approximately 160 revolutions per minute. The geared motor in itself runs in this case only up to 5 revolutions per minute. As, however, the process according to the invention uses precisely the rotational speed range between 0 and 150 revolutions per minute, this two-motor design is not suitable for the present process.

Furthermore, the centrifugal dryer on which the process according to the invention is carried out is intended to have a suitable regulating system. In particular, the centrifugal dryer must be capable of controlling the injections through the swirl nozzles 30 in the millisecond range. It must be possible to detect the position of the drum 10 in the minute range (based on the angular position). This requires, in particular, a play-free and rigid coupling between the drive shaft 20 and the motor. This can be suitable provided by a single-motor design.

Figure 3:
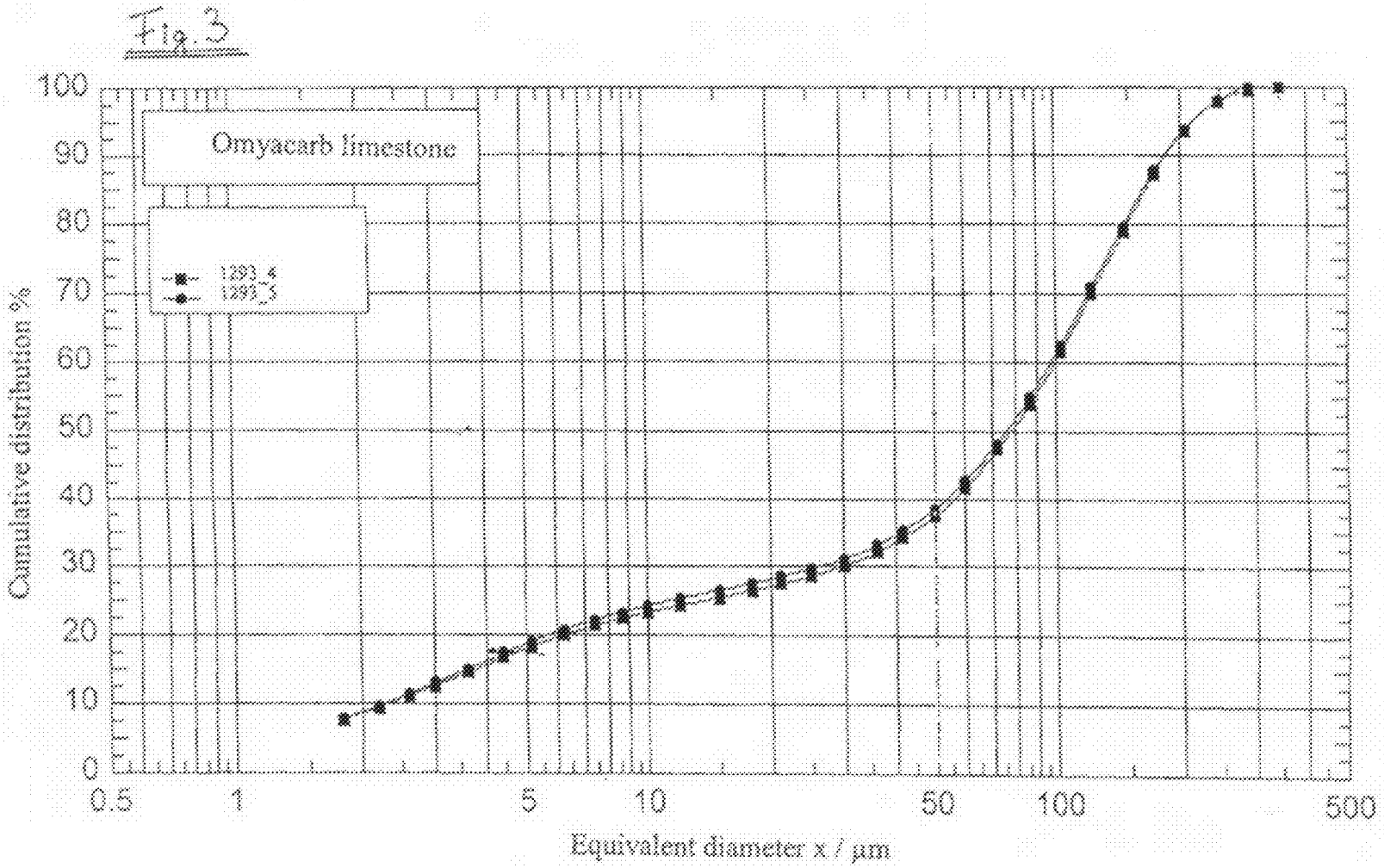
FIG. 3 shows the grain size spectrum of a problematic product which is cited merely by way of example and can be centrifuged and dried particularly advantageously by the process according to the invention.

FIG. 3 shows the grain size spectrum of a typical product which can be processed using the process according to the invention. As shown in FIG. 3, the product has a fine content of approximately 20%. Approximately 20% of the product has a grain size of 10 μm or less. However, the illustrated product should not be regarded as entailing limitation for the use of the process according to the invention. The process according to the invention rather provides improved centrifuging and drying in all types of products.

When carrying out the process according to the invention, a product suspension is initially loaded, in a first loading step, into the working region 60 through the drive shaft 20 which is configured as a loading shaft. The drum 10 rotates continuously during loading. The rotational speed of the drum is in this case selected such that the forces in the radial direction are so high that a ring consisting of the product suspension forms on the filter 16.

As early as during loading, a suitable fluid can be injected into the working chamber by means of the swirl nozzles which are generally denoted by reference numeral 30. In this case, the swirl nozzles 30 are moved up close to the drum base, so that merely a minimal gap is situated between the nozzle head 38 and the drum base 12. It should be noted that the swirl nozzles 30 are at all times stationary, whereas the drum 10 rotates. In order to be able to move the swirl nozzles 30 up to the drum base 12 as is desired, the swirl nozzles can be configured so as to be axially movable. A feed channel 34 is in this case surrounded by bellows 36 and the swirl nozzles 30 can be moved axially by means of a suitable device.

The term "a suitable fluid" refers in principle to a fluid which does not cause any chemical reactions in the product and does not otherwise damage the product. The fluid which is used is generally gaseous.

The swirl nozzles 30 inject the fluid through the slots first in the annular space 18 from which the fluid moves into the working space 60 through the filter 16. The fluid leaves the working space 60 again at a different point in the opposite direction through the filter 16 and escapes through the drum base openings 14 and the outlet 54.

A first nozzle 31 and a second nozzle 32 inject into the same oblong hole 14' during a first revolution. During the next revolution of the drum, they inject the fluid into the next oblong hole 14", i.e. that offset by one oblong hole, etc. This ensures that the product is swirled over the entire circumference of the drum. The swirling thus takes place whenever the corresponding drum portion passes through the region between 6 and 7 o'clock.

During loading, an initially thin ring consisting of solids forms on the filter. A suspension consisting of the liquid component and the remaining solids is situated within this ring, further suspension being loaded continuously up to a maximum amount. However, owing to the low viscosity of the liquid component and the poor transfer associated therewith of shearing forces in the suspension, the suspension cannot build up to form a stable ring. As a result, the suspension forms a suspension lake within the solid ring. The shearing forces are however sufficiently great that an approximately 1 mm-thin suspension layer forms on the inside of the solid ring.

However, as a result of the swirling of the suspension lake owing to the rotation of the drum, the process according to the invention prevents sedimentation of the suspension and separation of the product components having relatively large particle sizes from the fine components during loading.

Furthermore, the increase in the porosity of the solid ring owing to the injecting of fluid by means of the swirl nozzles and the rapid filtering-out resulting therefrom of the liquid prevent sedimentation of the solid component in the approximately 1 mm-thin suspension ring.

Once all of the suspension amount has been loaded, the loading step subsequently merges with the centrifuging step. The drum 10 rotates during centrifuging at a suitable rotational speed, at a drum diameter of 400 mm, for example, 150 rpm or sufficiently rapidly that 5 g act on the cake, and the suspension is continuously loosened up by injecting fluid by means of the swirl nozzles 30. This prevents the product components having a relatively small grain size from mixing with the product components having a relatively large grain size and clogging the capillary required to drain the liquid phase. The filter itself is not clogged by the fine product components either, as the fluid gas regularly flows through it in the opposite direction.

In the case of less problematic products which do not clog rapidly and can also be centrifuged in the conventional manner, it is of course also possible to carry out the loading and centrifuging step in the previously known manner and not to commence the constant injecting according to the invention of a suitable gaseous fluid until the drying step. For example, the loading and centrifuging can be carried out at a drum speed of 500 rpm or at radial acceleration of 55 g, and the drum speed can be lowered to 150 rpm merely for the purposes of drying.

The centrifuging step merges seamlessly with the drying step. The rotational speed of the drum 10 is, at a drum diameter of 400 mm, approximately 150 rpm during drying. The annular construction of the product cake is in this case preserved and the product cake does not collapse. The swirl nozzles 30 then inject a hot drying gas into the working space 60. As described hereinbefore, the hot drying gas has to infiltrate the product cake twice. This achieves particularly high drying effectiveness. In addition, the product cake is dried from two sides uniformly. In addition, as a result of the constant loosening-up of the product cake over the entire circumference and the stationary preservation of the ring form of the product cake, the product does not form any lumps. Since an annular cake is preserved throughout the drying process, the product itself acts as an additional filter which prevents the fine component of the product from escaping through the filter 16.

In addition, hot drying gas can likewise be introduced into the working space 60 through the drive shaft 20. The hot drying gas can additionally increase the drying speed of the product. Since drying cracks are prevented in the product by the constant loosening-up, the drying gas situated in the working space 60 cannot simply escape through the drying cracks but rather passes through the entire product, thus additionally increasing the drying effectiveness.

Once the product has been dried as is desired, the drying step is followed by a homogenisation step. In this case, the rotational speed of the drum is reduced, for a drum having a diameter of 400 mm, from 150 rpm to approximately 50 to 80 rpm or to radial acceleration of less than 1 g. The product cake then collapses. The product then has the form of a fine powder which collects at the low point of the drum 10 and is entrained by the drum 10 in the direction of the vertex 70 of the drum 10. However, before reaching the vertex 70, the product trickles back down in the direction of the low point of the drum 10. Thorough mixing and homogenising of the product are thus achieved, as a result of which the differing grain sizes and remaining moist components are soon distributed uniformly in the product. In addition, a gas can again be injected into the working space 60 through the swirl nozzles 30 in order additionally to loosen up the product. However, this is not absolutely necessary during the homogenisation step.

Following the homogenisation step, the dried product can be removed as a fine powder.

It should be recalled that the above-specified rotational speeds are to be understood merely as an example for a centrifugal dryer having a drum diameter of 400 mm. Other rotational speeds which produce the same effect should be selected for other drum diameters. In particular, the rotational speed should be selected during drying such that the ring form of the product cake is preserved at all times.

The above-described process according to the invention allows for the first time economically beneficial centrifuging and drying of products which tend to form lumps. In contrast to conventional processes which produced, in the case of problematic products of this type, merely a sludge which consists of lumps and has a high liquid content, the process according to the invention allows a dry fine powder to be attained.

In addition, the process according to the invention provides in the case of all types of products, i.e. even in the case of products which were previously deemed not to be problematic, a relatively short drying time owing to the relatively high porosity of the product during processing. The process according to the invention is thus not limited to the problematic products illustrated, for example, in FIG. 3 but rather can advantageously be applied in the case of all types of products in the chemical and in the pharmaceutical sector, as well as in the food field and in all types of centrifuges.

The invention claimed is:

1. A process for operating a centrifuge comprising a drive shaft used for loading, a drum which is connected to the drive shaft and has a drum casing and a drum base, a filter with a working region situated within the filter, an annular space formed between the filter and the drum casing, at least one drum base opening which is formed in the drum base and opens out into the annular space, and at least one swirl nozzle which is arranged in such a manner that it injects a fluid through the at least one drum base opening into the annular space, the process comprising the following steps:

loading a suspension of a product into the working region through the drive shaft, centrifuging the suspension of the product, drying the product, wherein the drum rotates continuously during drying, and a fluid is injected into the drum through the annular space by means of the at least one swirl nozzle, and the rotational speed of the drum during drying is selected such that a product cake formed in the drum does not collapse.

2. The process according to claim 1, wherein the drum rotates continuously during loading.

3. The process according to claim 2, wherein during loading a fluid is injected into the working region through the annular space by means of the at least one swirl nozzle.

4. The process according to claim 1, wherein during centrifuging a fluid is injected into the working region through the annular space by means of the at least one swirl nozzle.

5. The process according to claim 1, wherein during centrifuging the internal pressure of the drum is increased.

6. The process according to claim 1, wherein during drying a fluid is led into the drum through the drive shaft.

7. The process according to claim 6, wherein the drum rotates during homogenising, as a function of a diameter of the drum, at a rotational speed which results in similar acceleration of the product in the radial direction to a rotational speed of approximately 90 revolutions per minute at a diameter of the drum of approximately 400 mm.

8. The process according to claim 6, wherein the drum rotates during homogenising, as a function of a diameter of the drum, at a rotational speed which causes in the product cake radial acceleration of less than 1 g.

9. The process according to claim 1, further comprising the following step:

homogenising the product after drying of the product suspension, wherein the drum rotates continuously and rotates more slowly during homogenising than during drying.

10. The process according to claim 1, wherein the rotational speed of the drum during homogenising is selected such that the product falls down before reaching the summit of the drum.

11. The process according to claim 1, wherein at least two swirl nozzles are provided.

12. The process according to claim 11, wherein a first swirl nozzle of the at least two swirl nozzles is arranged laterally offset from a low point of the drum.

13. The process according to claim 12, wherein the first swirl nozzle is offset relative to the low point of the drum by approximately 30°.

14. The process according to claim 11, wherein a second swirl nozzle of the at least two swirl nozzles is arranged approximately at the low point of the drum.

15. The process according to claim 11, wherein the first and the second swirl nozzle inject the fluid into the same drum base opening during a revolution of the drum.

16. The process according to claim 15, wherein the first and the second swirl nozzle inject the fluid into a first drum base opening during a first revolution of the drum and the fluid into a second drum base opening during a second revolution immediately following the first revolution.

17. The process according to claim 16, wherein the second drum base opening is offset relative to the first drum base opening by one drum base opening.

18. The process according to claim 11, wherein the first and the second swirl nozzle inject the fluid into various drum base openings during a revolution of the drum.

19. The process according to claim 1, wherein the drum rotates during loading and centrifuging, as a function of a diameter of the drum, at a rotational speed which results in similar acceleration of the product in the radial direction to a rotational speed of approximately 500 revolutions per minute at a diameter of the drum of approximately 400 mm.

20. The process according to claim 1, wherein the drum rotates during centrifuging, as a function of a diameter of the drum, at a rotational speed which results in similar acceleration of the product in the radial direction to a rotational speed of approximately 150 revolutions per minute at a diameter of the drum of approximately 400 mm.

21. The process according to claim 20, wherein the drum rotates during loading, as a function of a diameter of the drum, at a rotational speed which results in similar acceleration of the product in the radial direction to a rotational speed of approximately 150 revolutions per minute at a diameter of the drum of approximately 400 mm.

22. The process according to claim 1, wherein the drum rotates during loading and centrifuging at a rotational speed which causes in the product cake radial acceleration approximately in a range of from 50 to 600 g.

23. The process according to claim 1, wherein the drum rotates during centrifuging at a rotational speed which causes in the product cake radial acceleration approximately in a range of from 1 to 10 g.

24. The process according to claim 23, wherein the drum rotates during loading at a rotational speed which causes in the product cake radial acceleration approximately in a range of from 1 to 10 g.

25. A process according to claim 23, wherein the acceleration which is caused is 5 g.

26. A process for operating a centrifuge comprising a drive shaft used for loading, a drum which is connected to the drive shaft and has a drum casing and a drum base, a filter with a working region situated within the filter, an annular space formed between the filter and the drum casing, at least one drum base opening which is formed in the drum base and opens out into the annular space, and at least one swirl nozzle which is arranged in such a manner that it injects a fluid through the at least one drum base opening into the annular space, the process comprising the following step:

centrifuging a suspension of a product, wherein during centrifuging a fluid is injected into the working region through the annular space by means of the at least one swirl nozzle.

27. A process according to claim 26, wherein the drum rotates during centrifuging, as a function of a diameter of the drum, at a rotational speed which results in similar acceleration of the product in the radial direction to a rotational speed of approximately 150 revolutions per minute at a diameter of the drum of approximately 400 mm.

28. A process according to claim 26, wherein the drum rotates during centrifuging at a rotational speed which causes in the product cake radial acceleration approximately in a range of from 1 to 10 g.

29. A process according to claim 26, wherein the drum rotates during loading, as a function of a diameter of the drum, at a rotational speed which results in similar acceleration of the product in the radial direction to a rotational speed of approximately 150 revolutions per minute at a diameter of the drum of approximately 400 mm.

30. A process according to claim 26, wherein the drum rotates during loading at a rotational speed which causes in the product cake radial acceleration approximately in a range of from 1 to 10 g.

* * * * *